United States Patent [19]

Manservisi

[11] Patent Number: 4,798,349

[45] Date of Patent: Jan. 17, 1989

[54] AUTOMATIC DEVICE FOR FEEDING BOBBINS OF A WRAPPING MATERIAL WEB, PARTICULARLY BOBBINS OF CIGARETTE PAPER

[75] Inventor: Renato Manservisi, Bologna, Italy

[73] Assignee: SASIB S.p.A., Italy

[21] Appl. No.: 104,951

[22] Filed: Oct. 6, 1987

[30] Foreign Application Priority Data

Nov. 14, 1986 [IT] Italy ..... 12580 A/86

[51] Int. Cl.[4] ..... B65H 19/12; B65H 19/18

[52] U.S. Cl. ..... 242/58.1; 242/58.6; 242/68.3; 242/72 R

[58] Field of Search ..... 242/58–58.6, 242/79, 68.3, 72 R

[56] References Cited

U.S. PATENT DOCUMENTS

| | | | |
|---|---|---|---|
| 3,806,058 | 4/1974 | Munchbach | 242/58.6 X |
| 3,877,653 | 4/1975 | Foltyn et al. | 242/79 X |
| 4,441,662 | 4/1984 | Seragnoli | 242/58 |
| 4,614,075 | 9/1986 | Focke et al. | 242/58 X |
| 4,646,986 | 3/1987 | Heitmann | 242/58.1 |

FOREIGN PATENT DOCUMENTS

| | | | |
|---|---|---|---|
| 1532203 | 1/1970 | Fed. Rep. of Germany | 242/58.4 |

*Primary Examiner*—John M. Jillions

*Attorney, Agent, or Firm*—Larson and Taylor

[57] ABSTRACT

A device for automatically feeding bobbins (B) of a wrapping material web (N), particularly bobbins of cigarette paper, to a substantially horizontal mandrel (1) provided with a circle of radially movable jaws (11). The bobbins rest by their lower peripheral surface on a bobbin-carrying cradle (27) which can be stepwise advanced toward the mandrel (1), in the axial direction thereof. The axis of mandrel (1) is eccentric and is upwardly offset with respect to the axis of a bobbin (B) resting on the bobbin-carrying cradle (27) and having the maximum allowable outside diameter within the tolerance limits thereof. At each forward step of the bobbin-carrying cradle (27), the bobbin (B) being each time the leading bobbin is fitted in an eccentric position on the circle of retracted jaws (11) of the mandrel (1). The jaws (11) are then outwardly moved, whereby the bobbin (B) is trued on the mandrel (1) and is lifted from the bobbin-carrying cradle (27).

17 Claims, 6 Drawing Sheets

AUTOMATIC DEVICE FOR FEEDING BOBBINS OF A WRAPPING MATERIAL WEB, PARTICULARLY BOBBINS OF CIGARETTE PAPER

SUMMARY OF THE INVENTION

The object of the invention is a device for automatically feeding to a substantially horizontal mandrel bobbins of a web of wrapping material, or the like, particularly bobbins of cigarette paper, which preferably are each provided with a tubular core and are advanced one after the other toward the mandrel, in the axial direction thereof, by means of a bobbin-carrying cradle which can be intermittently operated and on which the bobbins rest by their lower peripheral surface, in a position being substantially co-axial to the mandrel. The mandrel is provided with a co-axial circle of jaws which are radially movable upon control, and which permit, when set in their radially retracted position, that at each forward step of the bobbin-carrying cradle, the bobbin each time leading the set of bobbins provided on the bobbin-carrying cradle can be freely slipped on the mandrel, while the said jaws engage, when set in their radially outwardly moved position, the bobbin having been threaded thereon, and clamp the same to the mandrel.

In the known feeding devices of the above-stated kind, the bobbins provided on the slidable bobbin-carrying cradle must be exactly co-axial to the mandrel. The outside diameter of the normal bobbins of a wrapping material web, particularly the outside diameter of cigarette paper bobbins, however often varies within very wide tolerances, so that the bobbins being fed to the mandrel while resting by their lower peripheral surface of the bobbin-carrying cradle, frequently are not co-axial to the mandrel. Troubles arise which impair the automatic operation of the feeding device. Moreover, in the known devices of the above-stated kind, after each bobbin-carrying cradle advancing step, to have a bobbin fitted on the mandrel, the bobbin-carrying cradle must be moved backward to be disengaged from the bobbin fitted on, and clamped to the mandrel, in order to permit the rotation of said bobbin.

In the first place, the invention aims to eliminate these drawbacks in the feeding devices of the kind as described in the preamble, and to obtain a reliable automatic transfer of the bobbins from the bobbin-carrying cradle to the mandrel, independently from any possible variation in the outside diameter of the bobins within the limits of the respective tolerances and without having to b move backward the bobbin-carrying cradle after each forward step of said cradle.

This problem is solved by the invention in that the axis of the mandrel is eccentric, and is upwardly offset with respect to the height position of the axis of the bobbin resting on the bobbin-carrying cradle and having the maximum allowable outside diameter, while the said eccentric position of the mandrel axis and the outside diameter of the circle of radially retracted jaws, as well as the inside diameter of the bobbin core, are so selected that on the circle of retracted jaws there can be fitted in an eccentric position any bobbin resting on the bobbin-carrying cradle and having an outside diameter within the respective tolerance limits, while by the outward movement of the jaws, the bobbin having been fitted thereon is trued on the mandrel and is lifted from the bobbin-carrying cradle.

Thus, bobbins having an outside diameter that can freely vary within very wide, predetermined limits, can be fitted on the mandrel directly from the bobbin-carrying cradle, automatically, without any trouble. Moreover, since the bobbin fitted on the mandrel is automatically lifted from the bobbin-carrying cradle at the time it is trued on, and is clamped to the mandrel by means of the circle of jaws, the bobbin-carrying cradle must not be caused to make any backward movement, and the same can be driven, according to a further feature of the invention, only in one direction, that is, toward the mandrel, thus attaining a considerable siplifying of the feeding device.

The said unidirectional intermittent movement of the bobbin-carrying cradle permits also the realization of one embodiment of the invention, in which the mandrel is mounted on a cantilevered mandrel-carrying arm, under which there extend means for guiding and supporting the slidable bobbin-carrying cradle, and under which there can pass the emptied bobbin-carrying cradle. Thus, while the bobbin-carrying cradle is transferring its bobbins to the mandrel, one at each forward step of the bobbin-carrying cradle, this cradle passes under the cantilevered mandrel-carrying arm and comes out of the feeding device. Therefore, it is possible to obtain a unidirectional flow through the device of successive bobbin-carrying cradles, with an inlet for the filled bobbin-carrying cradles, and an exit for the emptied bobbin-carrying cradles, thus considerably simplifying the replacement of the depleted bobbin-carrying cradles, and so the entire bobbin-feeding process.

According to a further advantageous embodiment of the invention, the bobbin-carrying cradles are advanced toward the mandrel by means of a worm screw, with which each bobbin-carrying cradle is engaged through a threaded driving element which is connected to the bobbin-carrying in such a manner that it can yield elastically in the radial direction with respect to the worm screw. Preferably, after each forward step of the bobbin-carrying cradle, the correct position of said cradle, in which the same transfers to the mandrel the bobbin being each time the leading bobbin, is determined by a positioning stop member consisting, for example, of a latch which cooperates with a series of notches in the bobbin-carrying cradle. In this embodiment, the bobbin-carrying cradles being fed one after the other to the mandrel, are automatically coupled through their elastically yieldable, threaded driving members, to the cradle-advancing device consisting of the worm screw, and the driving in rotation of the worm screw may even be imperfectly synchronized with the control of the positioning stop member, that is, it can be continued even after the first bobbin-carrying cradle has been stopped in the position for transferring a bobbin to the mandrel, since, in this case, the threaded member for driving the bobbin-carrying cradle or cradles will be automatically disengaged from the worm screw and will elastically hop on the said worm screw.

According to a further feature of the invention, the mandrel is so mounted as to be axially retractable upon control with respect to an abutment member for slipping off the core of the bobbin mounted on said mandrel. Thus, after the depletion of a bobbin which is mounted on the mandrel, the mandrel is temporaneously retracted in the axial direction, to a sufficient extent for the depleted bobbin core having been previously released from the mandrel jaws, to be slipped off the mandrel and be caused to fall thereoff by means of the stationary slipping off abutment member. The mandrel is then returned into its normal axial position, in which it receives the next bobbin from the bobbin-carrying cradle. The slipped off core of the depleted bobbin may be collected in any suitable manner. Preferably, however, according to one preferred embodiment of the invention, the bobbin-carrying cradle is divided by means of transversal partition walls into a succession of compartments which are adapted for containing each one bobbin. In this case, after the depletion of a bobbin which is mounted on the mandrel, the bobbin core slipped off the mandrel in the manner as above disclosed, drops into the underlying compartment of the bobbin-carrying cradle, in which the respective bobbin originally lied.

Therefore, filled bobbin-carrying cradles containing one bobbin in each one of their compartments, move into the feeding device according to the invention, while emptied bobbin-carrying cradles carrying in each compartment the core of the respective depleted bobbin, move out of the said device.

The feeding device according to the invention may be associated with only one mandrel when this mandrel is meant for feeding a machine that can tolerate an interruption in the feeding of the web during the time intervals needed for replacing a depleted bobbin with a fresh bobbin.

The invention is however applicable with the same advantages as above described also to automatic bobbin-changing apparatus comprising two mandrels, of which one carries the operative bobbin and the other a reserve bobbin, which latter bobbin automatically takes over the function of operative bobbin when the preceding bobbin becomes depleted. The automatic bobbin-changing appartus is provided with a splicer that automatically joins the trailing end of the web from the depleted bobbin with the leading end of the web from the reserve bobbin, without bringing about any interruption in the feeding of the web to the respective web-using machine. The automatic bobbin-changing apparatus of this kind are known, and are particularly used for supplying the web of cigarette paper to cigarette-making machines. In these automatic bobbin-changing apparatus, an automatic bobbin-feeding device according to the invention is associated with each mandrel. Preferably, the two bobbin-feeding devices are arranged parallel to each other, the one at the side of the other, with the respective mandrels being parallel to each other and being transversely set side-by-side, while the web splicer is provided between the two bobbin-feeding devices, in the transversal plane in which lie the bobbins mounted on the mandrels. Moreover, according to a further feature of the invention, the leading end of the web from the bobbins contained in the bobbin-carrying cradles of the two feeding devices is held to the respective bobbin-carrying cradle on the side of said cradle which is turned toward the splicing device, in a position just ready for its splicing.

DESCRIPTION OF THE DRAWINGS

These and other features of the invention, and the advantages arising therefrom will clearly appear in more detail in the following description of one preferred embodiment, which is shown by way of a non-limiting example in the accompanying drawings, in which.

DESCRIPTION OF THE PREFERRED EMBODIMENTS

In the figures, numerals 1 and 1' denote two spaced apart, substantially horizontal mandrels arranged parallel to each other. Each mandrel 1, 1' is intended for supporting a bobbin B, B' of a wrapping material web, such as, for example, a web of cigarette paper, and one of these bobbins, for example the bobbin B, supplies the web-using machine, particularly a cigarette-making machine, and thus it is the operative bobbin, while the other bobbin B' is a reserve bobbin. Any time the operative bobbin B is about to become depleted, with the web N being unwound from this bobbin B, a supply is formed in a suitable magazine (not shown, since it is known per se), and the web N from the bobbin B in the course of becoming depleted is spliced by a splicing device G, G' with the leading end of the web N' from the reserve bobbin B', under stationary conditions of both webs N, N'. The web-using machine is then supplied with the web N' from the reserve bobbin B', which now becomes the operative bobbin, and a fresh bobbin B is fitted on the mandrel 1, to replace the depleted bobbin. The cycle is then repeated with the bobbin B as the reserve bobbin. Thus, the two mandrels 1, 1' alternate their function of supporting the operative bobbin and the reserve bobbin.

Both mandrels 1, 1' are mounted on the same side of two cantilevered mandrel-carrying arms 2, 2' extending toward each other from the frame C of the apparatus. The two mandrels 1, 1' preferably are of the controlled-rotation type, and are similar to each other. Therefore, one preferred embodiment will be described hereinafter only in connection with the mandrel 1, the other mandrel 1' being constructed in the same way.

Figure 1:
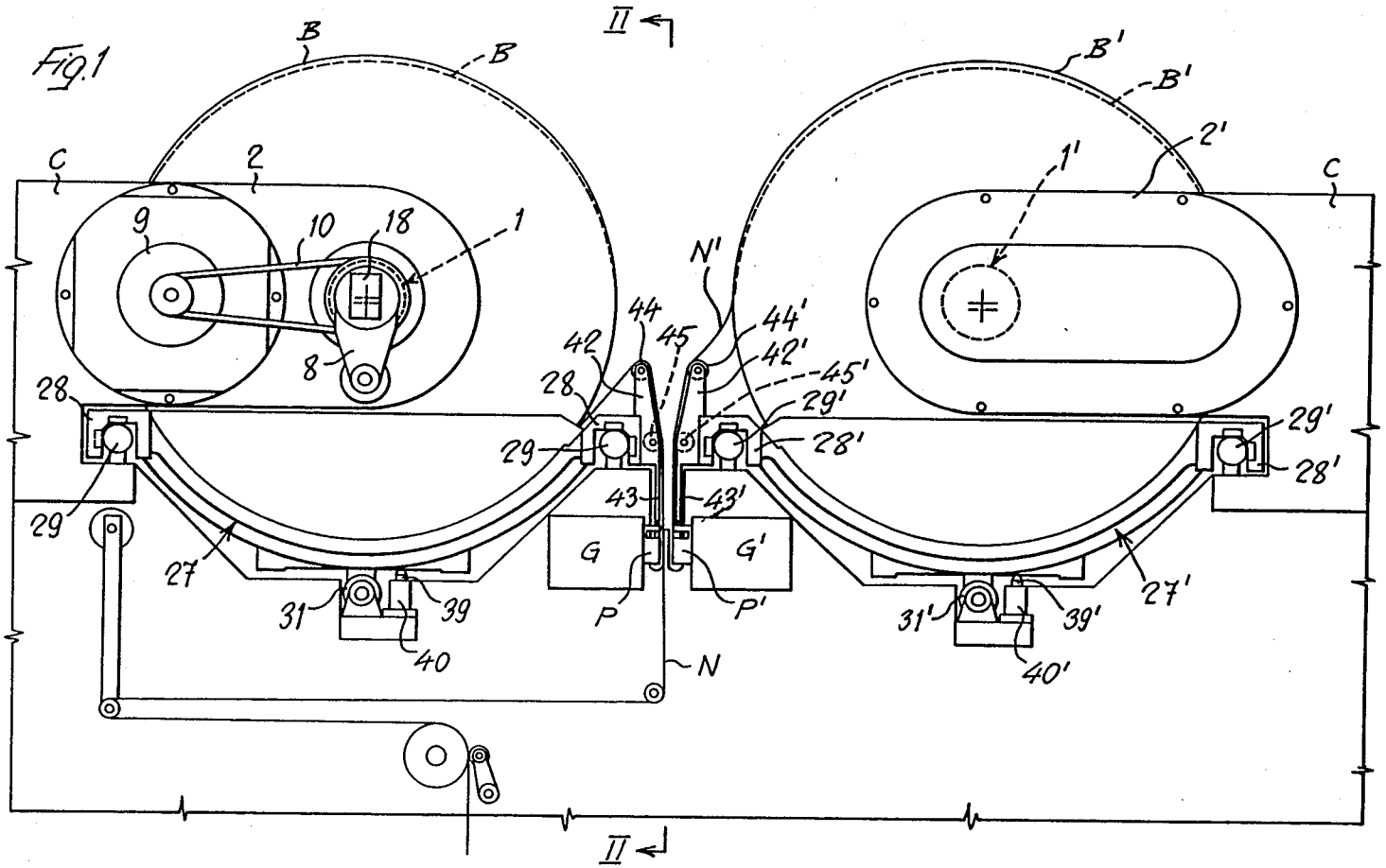
FIG. 1 is a front view in the direction of arrows I—I in FIG. 2, showing a bobbin-changing apparatus for cigarette paper bobbins, with an automatic bobbin-feeding device being associated with each one of the two mandrels.
Figure 5:
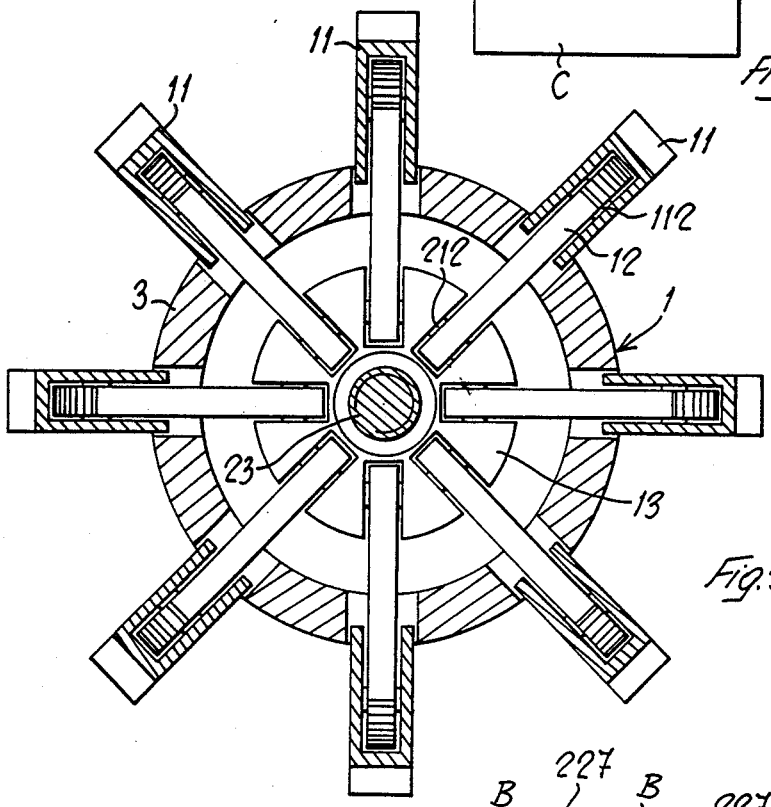
FIG. 5 is a radial sectional view on an enlarged scale, taken on line V—V in FIG. 3, diagrammatically showing the circle arrangement of the mandrel jaws.
Figure 3:
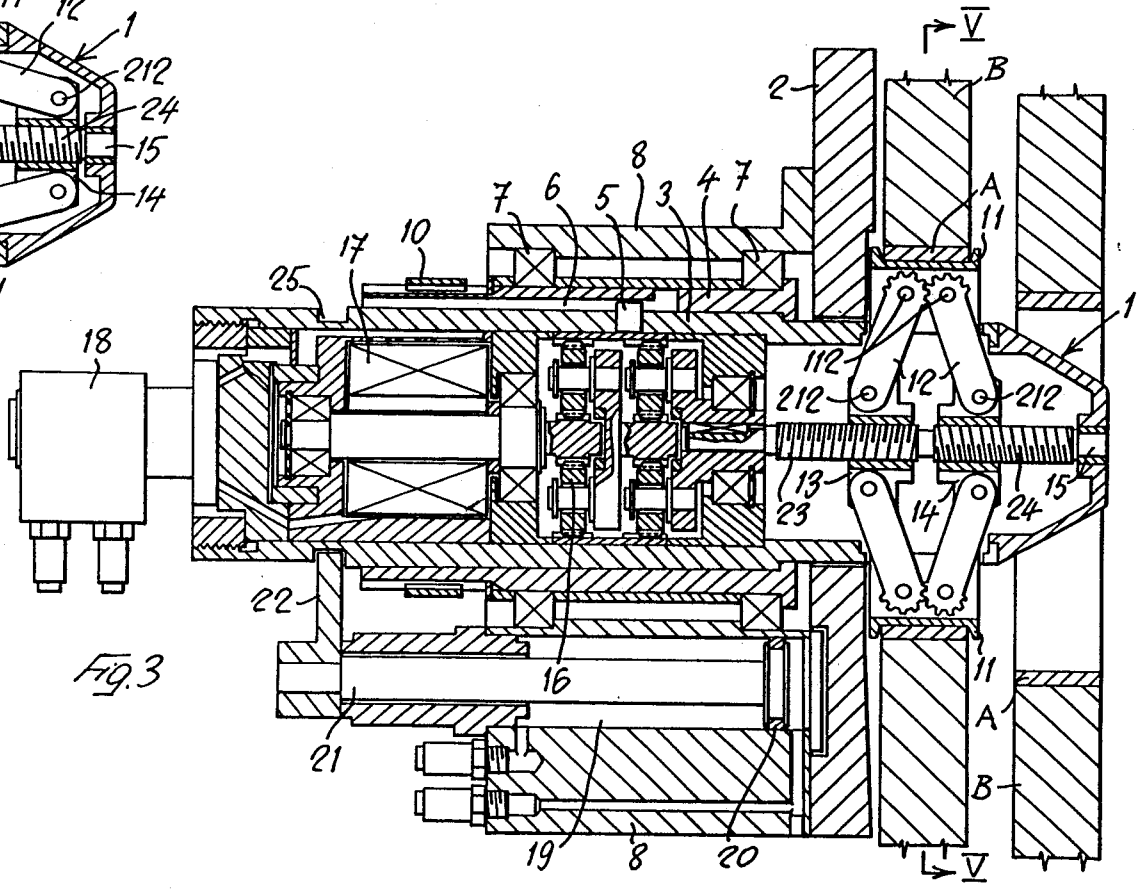
FIG. 3 is an axial sectional view on an enlarged scale, showing one of the mandrels in the bobbin-changing apparatus, with the jaws being radially moved out into active bobbin-gripping position.
Figure 4:
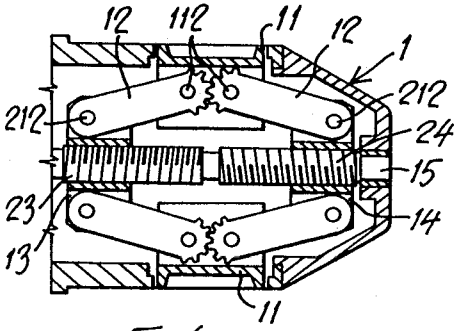
FIG. 4 is an axial sectional view showing only the extremity of the mandrel according to FIG. 3, with the jaws in retracted position.

Referring to FIGS. 3, 4, and 5, the mandrel 1 consists of a tubular body 3 having a closed foremost end portion shaped like a truncated cone, which is axially slidably but non-rotatably mounted in a sleeve 4. For this purpose, the tubular body 3 of the mandrel may carry at least one external radial pin 5 which is slidably engaged in a matching internal longitudinal groove 6 in sleeve 4. By means of bearings 7 the sleeve 4 is rotatably mounted in a supporting block 8, which is secured to the rear side of the mandrel-carrying arm 2. The tubular body 3 of mandrel 1 has its front portion extending through a bore in the mandrel-carrying arm 2, and is entrained in rotation by the sleeve 4, which through a toothed belt 10 is driven by a motor 9 (see also FIG. 1). At its front portion, the mandrel 1 is provided with a circle of angularly equispaced jaws 11 which are so guided as to be radially movable in respective peripheral slots in the tubular body 3 of said mandrel 1. These radially movable jaws 11 can alternately take a radially retracted position, shown in FIG. 4, in which by its tubular core A a bobbin B can be freely fitted on the mandrel 1 and on the circle of jaws 11, and a radially outwardly moved position, shown in FIG. 3, in which the jaws 11 are engaged with the core A of bobbin B fitted on the mandrel 1 in correspondence of said circle of jaws 11, so that they non-rotatably connect the said bobbin B with the mandrel 1. The controlled retraction and expansion movement of the circle of jaws 11 may be attained in any suitable manner. In the shown embodiment, the mutually meshing toothed ends of two lever arms 12 which lie in an axial plane of mandrel 1 and diverge from each other toward the axis of said mandrel, are pivotally connected at 112 to each jaw 11. The opposite, radially inward ends of the two lever arms 12 are pivotally connected at 212 to two separate nut screws 13 and 14 being one a right-handed, and the other a left-handed nut screw, which are threaded on two respective external threads 23 and 24 on an intermediate shaft 15 which is provided co-axially to the mandrel 1 at the interior of the tubular body 3 thereof. Through an epicyclic reduction gear 16 the shaft 15 is driven in rotation by a pneumatic vane motor 17 which together with the reduction gear 16 is housed at the interior of the tubular body 3 of mandrel 1, and is fed by a rotary distributor 18 provided at the rear end of said mandrel. By causing the shaft 15 provided with the external threads 23, 24 to rotate in the direction for drawing near to each other the two nut screws 13 and 14, and then the respective inward ends of the lever arms 12, these lever arms will radially push out the jaw 11 and cause the same to bear strongly against the inside surface of the core A of bobbin B fitted on the mandrel 1 (FIG. 3). Whereas, by causing the shaft 15 provided with the external threads 23, 24 to rotate in the direction for drawing away from each other the two nut screws 13, 14, and then the respective inward ends of the lever arms 12, these lever arms will radially retract the jaw 11 toward the inside, preferably up to position the same flush with the peripheral surface of the tubular body 3 of mandrel 1 (FIG. 4).

Figure 2A:
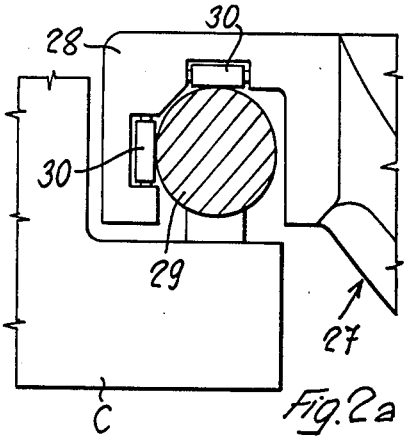
FIG. 2*a* is a view in an enlarged scale showing a detail of FIG. 2.
Figure 2:
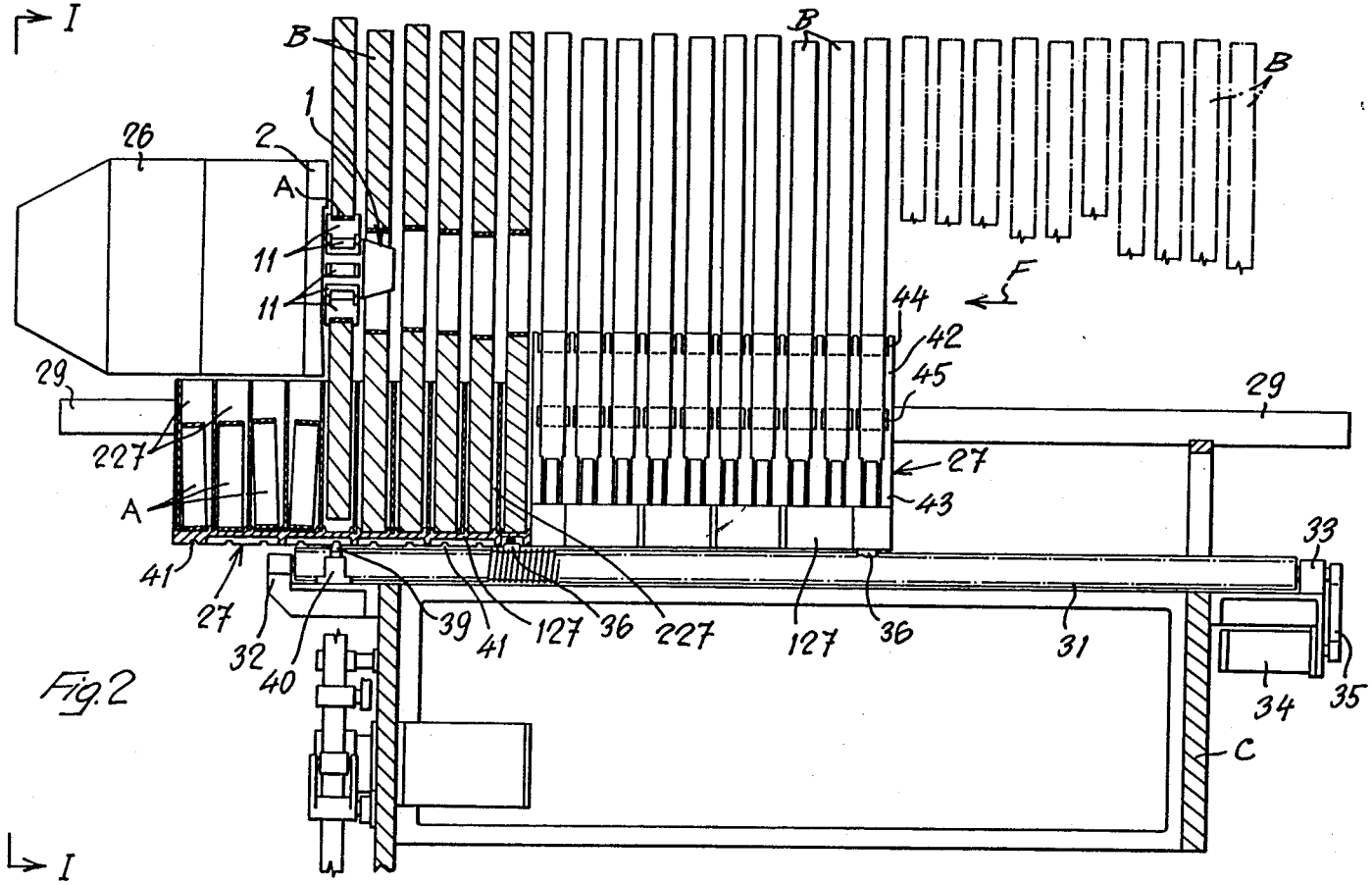
FIG. 2 shows the bobbin-changing apparatus in a longitudinal elevational view in the direction of arrows II—II in FIG. 1, with some parts in section.

The whole mandrel 1 is furthermore axially movable upon control along the inside of sleeve 4, between an operative position in which by its extremity comprising the circle of jaws 11 it projects forward from the mandrel-carrying arm 2, as shown in FIGS. 2 and 3, and a retracted, bobbin core A slipping off position in which it either lies fully concealed within the mandrel-carrying arm 2, or at least the circle of jaws 11 is retracted therewithin.

For such an axial movement of mandrel 1 along the inside of the supporting block 8 a cylinder 19 is provided, which is parallel to the axis of rotation of said mandrel 1, and which contains a double-acting piston 20, that is, a piston which can be alternatively loaded on either sides by means of a fluid under pressure, such as air. The rod 21 of piston 20 is led out of the supporting block 8 and carries a fork 22 which is engaged in an annular groove 25 provided in the outside of the rear end of the mandrel 1 body 3 which projects out of the sleeve 4. The assembly of the means for supporting and operating the mandrel 1 and its circle of jaws 11 is applied to the rear side of the mandrel-carrying arm 2, and is preferably enclosed in a protective casing 26, shown in FIG. 2.

Associated with each mandrel 1, 1' is a feeding device for automatically replacing the depleted bobbin with a fresh bobbin. These feeding devices are the same for the two mandrels 1, 1', so that only the device associated with the mandrel 1 will be described hereinafter. The corresponding parts of the feeding device associated with the other mandrel 1' are denoted with the same reference numerals, however provided with a prime mark (').

The bobbin-feeding device associated with the mandrel 1 comprises bobbin-carrying cradles 27 consisting each of a shell 127 in form of a segment of a circular hollow cylinder, which by means of transverse partitions is divided into a plurality of successive equal compartments 227, which are adapted for containing each one bobbin B. Each bobbin B is accomodated in a standing, i.e., vertical position, within the respective compartment 227 in cradle 27, and has its lower peripheral surface resting on the bottom of said cradle 27, which is formed by the shell 127 having the profile of a circle segment.

At its upper two longitudinal edges the bobbin-carrying cradle 27 has supporting pieces 28 shaped like an overturned U, by means of which it is slidably suspended from two guide rods 29 secured to the frame C of the apparatus. In the shown embodiment, the guide rods 29 are circular in profile, and the overturned U-shaped pieces 28 are provided at each one of their ends with a set of internal rollers 30, by means of which they are supported at the top and sidewise on said rods 29, as shown particularly in FIG. 2*a*. The guide rods 29 are horizontal, and are parallel to each other and to the axis of mandrel 1.

Figure 1A:
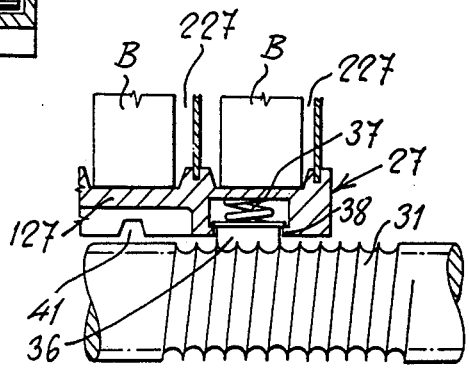
FIG. 1*a* is a view in an enlarged scale, showing a detail of FIG. 1.

At the front side of the cantilevered mandrel-carrying arm 2, that is, at the side of this arm 2 from which the mandrel 1 protrudes, the guide rods 29 are of such a length that they accomodate two or more bobbin-carrying cradles 27 the one after the other (FIG. 2). The guide rods 29 extend also on the opposite or rear side of the cantilevered mandrel-carrying arm 2, over a length which is suitable for containing at least one bobbin-carrying cradle 27. Moreover, the guide rods 29 are provided at such a height that the bobbin-carrying cradles 27 which are slidable thereon, can freely pass under the cantilevered mandrel-carrying arm 2, while the bobbins B which are accomodated in the bobbin-carrying cradles 27, are almost co-axial to the mandrel 1, as it will be described in more detail below. One or more successive bobbin-carrying cradles 27 filled with bobbins B are placed on the guide rods 29 in front of the mandrel 1, and are advanced by one step toward the mandrel 1 in the direction of arrow F, each time a full bobbin B has to be fitted on the mandrel 1, to replace a depleted bobbin. Such a stepwise forward movement of the bobbin-carrying cradle or cradles 27 is achieved by means of a worm screw 31 extending parallel to the guide rods 29 underneath the bobbin-carrying cradles 27, and which is rotatably mounted in end supports 32, 33, while through a drive 35 it is operated by a motor 34. A threaded driving block 36 projecting downwardly from the bobbin-carrying cradle 27 is mounted in a housing in the rear portion of the bottom of each bobbin-carrying cradle 27, and is engaged in the worm screw 31, as shown particularly in FIG. 1*a*. By a spring 37 the threaded driving block 36 is pushed out into abutment with a suitable catch member 38, so that it can elastically yield upward within its housing in the bottom of the bobbin-carrying cradle 27, up to become disengaged from the worm screw 31. After every forward step in the direction of arrow F toward the mandrel 1, the first bobbin-carrying cradle 27 is stopped in a position for transferring a bobbin to the mandrel 1. Such a stopping is determined by a latch 39 which is operated by a pneumatic cylinder 40 and which cooperates with a series of positioning notches 41 provided in the outside of the bottom of the bobbin-carrying cradle 27. Preferably, the stopping latch 39 is arranged beside the worm screw 31, in correspondence of the same transverse vertical plane in which the circle of jaws 11 of mandrel 1 is located in operative condition.

Since the outside diameter of bobbins B normally changes from bobbin to bobbin within certain tolerances, and since the bobbins B rest on the bobbin-carrying cradle 27 by the lower portion of their peripheral surface, the bobbins B, and then their cores A, generally are not perfectly co-axial to the mandrel 1.

In order to obviate such an inconvenience, the above-described device for feeding the bobbins B is so made that the axis of mandrel 1 is eccentric and is upwardly offset with respect to the axis of the bobbins B having the maximum allowable outside diameter within the limits of variation of said diameter. At the same time, the dimensions and the reciprocal positions of the several members are so selected that the following operation is obtained:

Let us assume, for example, to start from the position shown in FIG. 2, in which on the mandrel 1 there is mounted as the operative bobbin, the bobbin B taken from the fifth compartment 227 of the first bobbin-carrying cradle 27, supported by the guide rods 29. The circle of jaws 11 on mandrel 1 is expanded and clamps the core A of bobbin B to the mandrel 1. The bobbin B which is mounted on the mandrel 1 has its lower portion still housed within the respective compartment 227 in the bobbin-carrying cradle 27, but it is raised from the bottom or shell 127 of this cradle 27, so that it is allowed to rotate freely, by being driven by the mandrel 1. The first bobbin-carrying cradle 27 is locked in this position by means of the latch 39 which is engaged in a respective positioning notch 41 in said cradle 27.

The front section of the first bobbin-carrying cradle 27 which comprises the first four empty compartments 227 containing each only the core A of the bobbin originally accomodated therewithin, extends under the mandrel 1 and under the respective mandrel-carrying arm 2. The cradle-advancing screw 31 is generally stationary. When the bobbin on mandrel 1 becomes depleted, the jaws 11 of this mandrel are radially retracted, so that they come back into the tubular body 3, as shown in FIG. 4. Next, the whole mandrel 1 is axially retracted, so that the core A of the depleted bobbin B is slipped off said mandrel 1 by means of a slipping off stationary abutment member formed by the same mandrel-carrying arm 2. The thus slipped off core A drops into the underlying compartment 227 of the bobbin-carrying cradle 27, which compartment originally contained the just depleted bobbin B. The mandrel 1 is then moved axially forward, and is returned to its working position, in which it projects from the mandrel-carrying arm 2, while the jaws 11 are still kept retracted. The bobbin-carrying cradle 27 is then unlocked by withdrawing the latch 39, and it is advanced by one step in the direction of arrow F, toward the mandrel 1. For this purpose, the worm screw 31 is set in rotation. By this forward movement of the bobbin-carrying cradle 27, the next bobbin B carried thereby, and which in the shown embodiment is contained in the sixth compartment 227 of said cradle, is automatically slipped on the mandrel 1, up to bring its core A in correspondence with the circle of still retracted jaws 11. Before the bobbin B has reached this position for its transfer to the mandrel 1, the latch 39 is actuated, that is to say, a pressure is applied thereto, so that this latch immediately snaps into a positioning notch 41 and precisely locks the bobbin-carrying cradle 27 in a stopped position corresponding to the aforementioned position for the transfer of bobbin B to mandrel 1. After the bobbin B has been fitted on the mandrel 1, the cradle-advancing worm screw 31 is stopped. In the event that rotation of this screw 31 cotinues after the locking of the bobbin-carrying cradle 27 by the positioning latch 39, this does not bring about any inconvenience, since the threaded driving block 36 elastically yields radially upwards, so that it becomes disengaged from the screw 31 and elastically hops on the threads thereof. Subsequently, the jaws 11 of mandrel 1 are moved radially outwards, so that they become engaged with the core A of the fitted on bobbin B, and true this bobbin with respect to the mandrel 1, and firmly lock the same to said mandrel 1. At the same time, owing to the above-described initial eccentric position of mandrel 1, which is upwardly offset with respect to the axis of the bobbin B supported on the bobbin-carrying cradle 27, the trueing of said bobbin with respect to the axis of mandrel 1 as a result of the circle of jaws 11 being expanded, automatically causes also the lifting of the bobbin from the bottom 127 of the bobbin-carrying cradle 27, whereby the bobbin B is allowed to rotate freely during the following operative cycle, in which the web-using machine is supplied with the web N being unwound from this bobbin B.

Besides the first bobbin-carrying cradle 27 that feeds the mandrel 1, a plurality of successive bobbin-carrying cradles 27 can be placed one after the other on the guide rods 29, in any desired moment and without restraint in positioning same. In fact, by causing the cradle-advancing screw 31 to rotate also during the periods of time in which the first bobbin-carrying cradle 27 is stopped, the successive bobbin-carrying cradle or cradles 27 are automatically moved into contact with each other and with the first bobbin-carrying cradle 27, thus forming in front of the mandrel 1 a continuous succession of compartments 227 containing each one bobbin B. In this way, the automatic feeding of mandrel 1 with fresh bobbins B is ensured for a certain, even very long time, it being only required to periodically charge on the guide rods 29 one or more bobbin-carrying cradles 27.

Each bobbin-carrying cradle 27 rectilinearly travels along the device only in one direction F, and passes under the mandrel 1 and under the respective mandrel-carrying arm 2, and comes out of the device in empty condition, that is, it carries in each compartment 227 the core A of the bobbin B originally contained in the compartment.

Each bobbin-carrying cradle 27, 27′ associated with one mandrel 1, 1′ is provided with means for guiding the web N, N′ being unwound from the respective bobbin B, B′ mounted on the respective mandrel 1, 1′ and performing the function of operative bobbin, as well as with means for keeping the leading end of the web from the bobbins B, B′ contained in the bobbin-carrying cradle 27, 27′ in a position ready for its splicing to the trailing end of the web from a bobbin mounted on the opposite mandrel. Also these means in the bobbin-carrying cradles 27, 27′ associated with the two mandrels 1, 1′ are alike, so that they will be described only in connection with one cradle 27 D associated with the mandrel 1, while the corresponding members of the bobbin-carrying cradles 27′ associated with the mandrel 1′ are designated by the same reference numerals provided with the prime mark (′).

Figure 6:
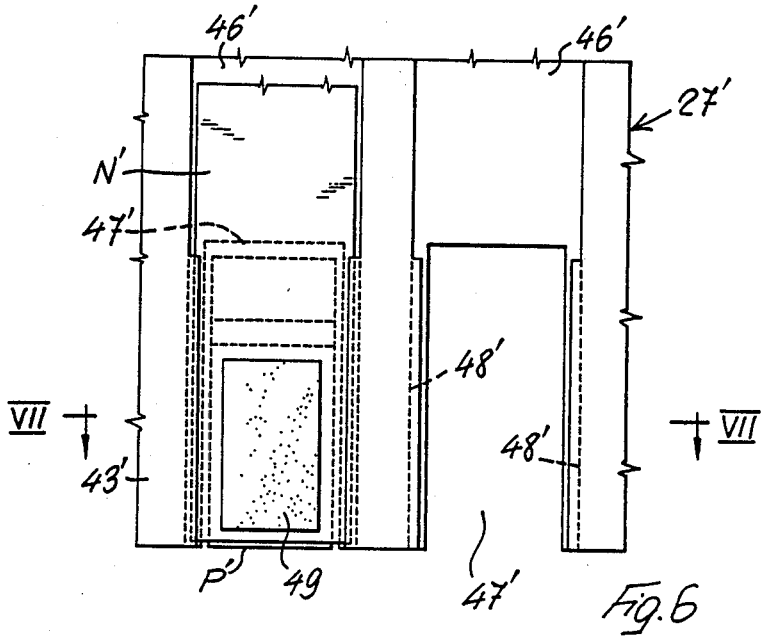
FIG. 6 is a side elevational view in the direction of arrows VI—VI in FIG. 8, an enlarged scale with respect to this latter figure, showing the device for holding the leading end of the web on the bobbins in the position ready for its splicing.
Figure 7:
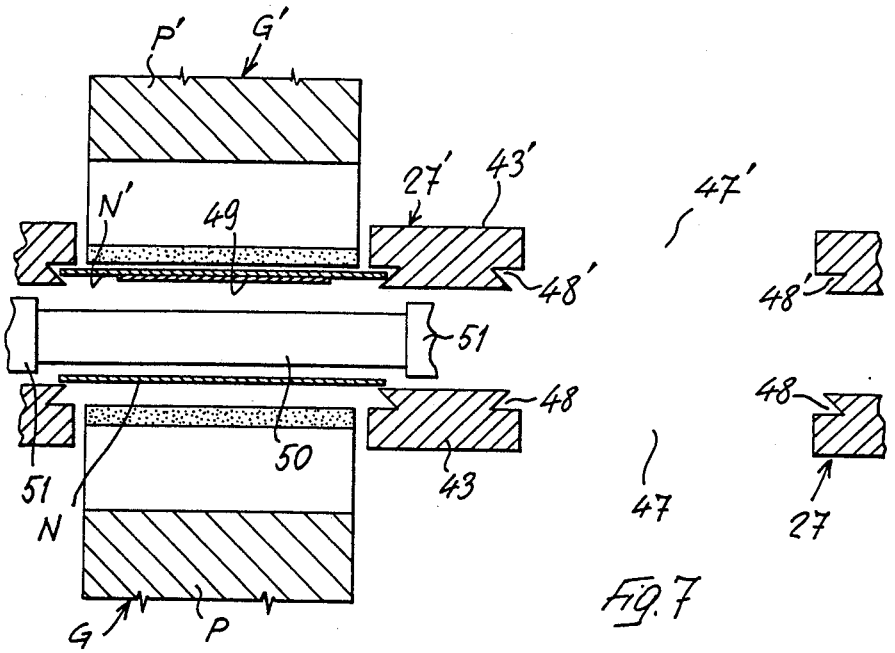
FIG. 7 is a horizontal sectional view through the splicing device, taken on line VII—VII in FIGS. 6 and 8.

In correspondence of its upper longitudinal edge turned toward the opposite mandrel 1′, each bobbin-carrying cradle 27 associated with the mandrel 1 has an upwardly extending side frame 42 which is prolonged in the downward direction by an apron extension 43. In correspondence of each compartment 227 in the bobbin-carrying cradle 27, two web-guiding rollers 44, 45 are rotatably mounted in the side frame 42, and the one 44 of them overhangs the upper edge of the side frame 42, while the other roller 45 is provided at a lower level on the external side of said side frame 42. The leading end of the web N being unwound from bobbin B contained in each compartment 227 of the cradle 27, is passed over the upper roller 44 and is led downward and about the lower roller 45. Then the end of web N is received in a respective vertical web-guiding groove 46 which is provided externally to the apron extension 43 under the lower roller 45, and terminates with a slot 47 extending as far as the lower edge of the said apron extension 43, as shown particularly in FIGS. 6 and 7.

The slot 47 has a width which is slightly smaller than that of the overlying groove 46 and of the web N, and its side edges are provided with facingly arranged, longitudinal web-engaging grooves 48 preferably having a V-like flaring profile.

In correspondence of the slot 47, the end of web N comes to be engaged by its edges in the lateral web-engaging grooves 48, and thus it is held with a weak force in the position ready for its splicing. In correspondence of the slot 47, the known bi-adhesive splicing tab 49 is applied to the outside of the end of web N.

The splicing device G, G′ is provided in correspondence of the transverse vertical plane in which lie the two bobbins B, B′ mounted on the mandrels 1, 1′. This splicing device comprises a stationary blade 50 extending parallel to the rods 29, 29′ for guiding the bobbin-carrying cradles 27, 27′, intermediately between these two pairs of rods 29, 29′, and being supported in the frame C by two vertical fingers 51. The apron extensions 43, 43′ of the bobbin-carrying cradles 27, 27′ associated with the two mandrels 1, 1′, and which are slidable on the respective guide rods 29, 29′, pass in facing relation along the two sides of the stationary blade 50, the longitudinal edges of which are both sharp, as it appears particularly in FIGS. 7 to 10. The splicing device consists of two splicing heads G, G′ fixedly arranged on opposite sides of the stationary blade 50, and comprising each a pressure member P, P′ which is movable horizontally and transversely to said blade 50, for example, by means of an associated pneumatic cylinder (not shown), as described in the Italian Pat. No. 1.056.576. The two pressure members P, P′ are set in a co-axial, facing relation, and have each a front indentation 52, 52′, into which the blade 50 can be inserted. The lower apron extensions 43, 43′ of the side frames 42, 42′ of the bobbin-carrying cradles 27, 27′ associated with the two mandrels 1, 1′, and being present on the respective pairs of guide rods 29, 29′ get in between the two splicing heads G, G′ and the stationary blade 50 in a freely slidable manner. In correspondence of the transverse vertical plane containing the two bobbins B, B′ mounted on the two mandrels 1, 1′, the slots 47, 47′ in the apron extensions 43, 43′ of the two opposite bobbin-carrying cradles, which are stopped by the respective positioning latches 39, 39′, are aligned with the pressure members P, P′ of the respective splicing heads G, G′. The pressure members P, P′ are so sized that they can pass through the said slots.

Figure 8:
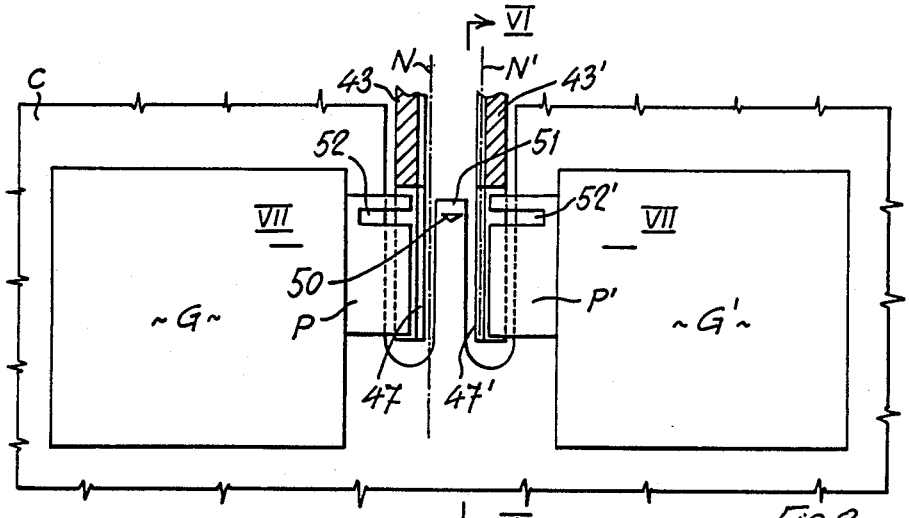
FIGS. 8 to 10 illustrate three successive steps of the operation of the splicing device, in an elevational view corresponding to FIG. 1, and on an enlarged scale with respect to this latter figure.

The operation of the above-described splicing device, to be described by referring to FIGS. 1, 8, 9, and 10, is as follows:

Let us assume that the bobbin B mounted on the mandrel 1 is the operative bobbin that supplies the web-using machine with the web N, while on the mandrel 1′ a reserve bobbin B′ is already mounted. In such a condition, the web N from the operative bobbin B passes over the web-guiding rollers 44, 45 and continues on its way toward the web-using machine, without being engaged in the lateral grooves 48 of the slot 47 in the apron extension 43 of the respective bobbin-carrying cradle 27, as shown in FIG. 8, and for the web N′ in FIG. 7. The leading end of the web N′ on the reserve bobbin B′ is instead engaged and held in the position ready for its splicing within the lateral web-engaging grooves 48′ of the slot 47′ in the apron extension 43′ of the respective bobbin-carrying cradle 27′, as shown in the same FIG. 8, and for the web N in FIG. 7. Both the pressure members P, P′ of the splicing units G, G′ are in an intermediate position, into which they are both partly advanced up to be engaged in the slots 47, 47′ in the apron extensions 43, 43′ of the respective bobbin-carrying cradles 27, 27′.

Figure 9:
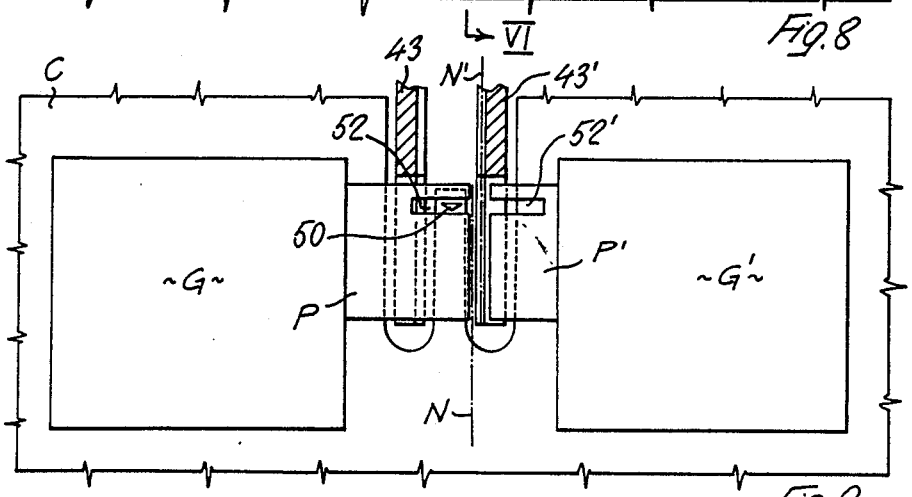

At the time the operative bobbin B is about to become depleted, with the web N being unwound therefrom, a sufficient supply is formed in known manner in a magazine (not shown), and then the bobbin B is stopped by stopping the respective mandrel 1. With the web N being stationary, the pressure member P of the splicing head G is further moved forward into an utmost advanced position, so that it passes through the slot 47 in the apron extension 43 of the associated bobbin-carrying cradle 27, and presses the web N against the bi-adhesive tab 49 provided on the leading end of the opposite web N′, which is supported by the respective pressure member P′ acting as a counter pressure member, as shown in FIG. 9. By this full forward movement, the pressure member P engages also the web N with the stationary blade 50, and causes the cutting of the tail of said web N, as more particularly illustrated in the Italian Patent Application No. 12559 A/84.

Figure 10:
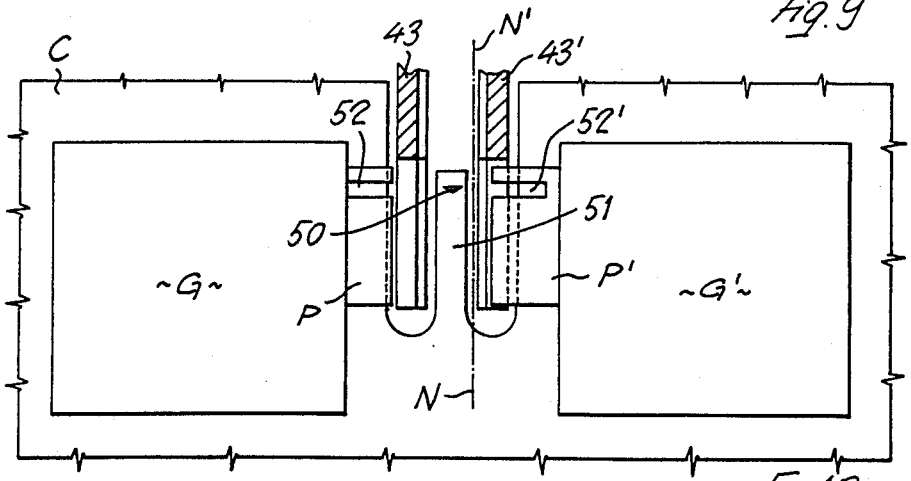

Once the splicing has been effected, the mandrel 1′ is so set in rotation that it reaches its working speed before the exhausting of the supply formed with the preceding web N in the above mentioned magazine. The bobbin B' mounted on mandrel 1' now becomes the operative bobbin, and its web N' is automatically disengaged from the lateral web-engaging grooves 48' of the slot 47' in the apron extension 43' of the respective bobbin-carrying cradle 27', as shown in FIG. 10. The pressure member P of the opposite splicing head G is instead retracted into a position in which it is disengaged from the slot 47 in the apron extension 43 of the respective bobbin-carrying cradle 27, so as to allow this cradle to be advanced by one step toward the respective mandrel 1, in order to have a fresh bobbin fed to said mandrel 1, as previously described. After the bobbin-carrying cradle 27 has been stopped in its new position, the pressure member P of the splicing head G is returned into its partly advanced position, according to FIG. 8. The condition is now attained which is the opposite of that shown in FIG. 7, i.e., the web-using machine is supplied with the web N' from the bobbin B' mounted on the mandrel 1', while the bobbin B mounted on the mandrel 1 is the reserve bobbin, and the leading end of the web N on this bobbin B is held in the position ready for its splicing, in correspondence of the slot 47 in the apron extension 43 of the respective bobbin-carrying cradle 27.

Of course, the invention is not limited to the just described and shown embodiment, and the same may be widely changed and modified. More particularly, the automatic bobbin-feeding device may be used even with only one mandrel, and it is not limited to a bobbin-changing apparatus with two alternately operative mandrels. Other modifications will be apparent without departing from the leading principle as set forth above and as claimed hereinafter.

I claim:

1. An apparatus for feeding bobbins, each having a tubular core and a web of wrapping material thereon, to a mandrel having a substantially horizontal axis, comprising:

advancing means for advancing the bobbins, one after another and one step at a time, in the axial direction of the mandrel, said avvancing means comprising an intermittently slidable bobbin carrying cradle, said cradle having a plurality of lower peripheral surfaces, each surface adapted to receive a bobbin resting thereon in a position with its bobbin axis generally parallel to the axis of the mandrel and generally axially aligned with the mandrel, the mandrel having a plurality of radially extendable and retractable jaws spaced about its periphery, such that in the radially retracted position the jaws loosely and freely receive a bobbin core, and in the radially extended position the jaws tightly engage the inside of the core of a bobbin, the mandrel and its jaws being positioned, relative to the advancing means, such that as the advancing means advances the bobbins one step, the leading bobbin is received on the mandrel, about the jaws, while the jaws are in their retracted position, the axis of the mandrel being located eccentrically upwards relative to the axis of a bobbin resting on its lower peripheral surface, with respect to a bobbin having the maximum allowable outside diameter permitted by the said cradle, whereby, the eccentricity of the mandrel, the outside diameter of the jaws in the retracted position and the inside diameter of the bobbin cores are so selected, for a bobbin of appropriate outside diameter for use with the apparatus, that as a bobbin is moved onto the mandrel and its retracted jaws, and the jaws are radially extended to tightly engage the bobbin case, the bobbin is trued, that is, its axis is made coaxial with the mandrel axis, and the bobbin is raised above its lower peripheral surface.

2. An apparatus according to claim 1, said bobbin carrying cradle being slidably mounted on substantially rectilinear supporting and guide means, which supporting and guide means are essentially parallel to the axis of the mandrel, the bobbin carrying cradle being movable on said supporting and guide means in only one direction, namely toward the mandrel.

3. An apparatus according to claim 2, the mandrel being mounted on a cantilevered mandrel-carrying arm, said supporting and guide means extending beneath said cantilevered mandrel-carrying arm, permitting the bobbin carrying cradle to pass under the mandrel and its cantilevered mandrel-carrying arm.

4. An apparatus according to claim 2, wherein the supporting and guide means are sufficiently long to support a bobbin carrying cradle large enough for at least two bobbins upstream from the mandrel and at least one bobbin downstream from the front of the mandrel, taken in the direction of movement of the cradle.

5. An apparatus according to claim 1, wherein the said advancing means comprises a worm screw extending generally parallel to the mandrel axis, means for intermittently operating the worm screw, and the screw engaging the bobbing carrying cradle by means of a threaded driving element which is yieldably connected to the bobbin carrying cradle such that the cradle can yield elastically in the radial direction relative to the axis of the worm screw to automatically disengage the cradle from the worm screw at any time that the bobbin carrying cradle is stopped.

6. An apparatus according to claim 1, including controlled positioning means for stopping the bobbin carrying cradle, after each of its forward steps towards the mandrel, in the correct position for transferring a bobbin to the said mandrel.

7. An apparatus according to claim 6, wherein the controlled positioning means comprises a controlled movable latch which cooperates with a succession of stop notches on the bobbin carrying cradle.

8. An apparatus according to claim 1, wherein each bobbin carrying cradle is divided into a series of comparments, each of which has a said lower peripheral surface adapted to receive one bobbin.

9. An apparatus according to claim 1, each radially extendable and retractable jaw being pivotally connected to a shaft, via a pair of lever arms which are inclined with respect to each other, each lever arm being pivotally connected to one of a pair of threaded nuts having opposite threads, one thread being right handed and the other thread being left handed, which nuts are threadedly engaged on respective opposite external threads on said shaft which is coaxially arranged within and with respect to the mandrel, and means for rotating the shaft to move the nuts along the shaft to effect inward and outward movement of the jaws.

10. An apparatus according to claim 9, wherein the ends of the lever arms which are pivotally connected to the jaws contain teeth and are in mesh with each other.

11. An apparatus according to claim 1, including a fixed abutment located ajacent the mandrel, and wherin the mandrel is axially retractable with respect to said fixed abutment, such that when the mandrel, with a bobbin mounted thereon is retracted within the abutment, the bobbin engages the fixed abutment and is thereby moved off of the mandrel.

12. An apparatus according to claim 11, wherein the mandrel is axially slidable within a rotatable sleeve and connected to the rotatable sleeve for rotation therewith, and including a piston and cylinder means for moving the mandrel axially relative to the rotatable sleeve to effect said axial movement relative to the fixed abutment.

13. An apparatus according to claim 1, in combination with a second, essentially mirror image of the same apparatus, the two apparatus arranged side-by-side with their respective mandrels side-by-side and essentially parallel to each other, and including an automatic splicer mounted on each apparatus, the two splicers comprising means for joining the leading end of the web from a first of said apparatus to the trailing end of a depleted bobbin from the other apparatus, and vice versa.

14. Apparatus according to claim 13, each of said apparatus having supporting and guide means on which its bobbin carrying cradle is mounted for movement in only one direction, towards its respective mandrel, and each apparatus having an independent means for effecting stepwise forward movement of its respective cradle and for controlling the stopping of its respective cradle at a specified position relative to its respective mandrel, the splicers being provided between the bobbin carrying cradles of the two apparatus and located in the same transverse plane as the bobbins mounted on their respective mandrels.

15. An apparatus according to claim 14, wherein the splicers comprise two oppositely arranged splicing heads, each provided with a movable pressure membe in facing relationship with the pressure member of the other spicing head, a stationary blade positioned between said pressure members, each bobbin carrying cradle having means at the location of each bobbin in the cradle for guiding the web of that bobbin so as to pass over its respective pressure member between its splicing means and the stationary blade, and including means for holding the leading edge of each web of each bobbin at a ready position arranged to be spliced to the trailing edge of a depleting bobbin of the other apparatus and for cutting the trailing end of the depleting bobbin by said stationary blade after splicing has been completed.

16. An apparatus according to claim 15, wherein each bobbin carrying cradle has, at the location of each bobbin, on the side edge of the cradle facing the splicer, at least one web guiding roller and an apron side frame extending downwardly between the associated splicer head and the stationary blade, and wherein each side frame has a downwardly extending slot adapted to allow the pressure member of the other splicing head to pass therethrough, said slots being peripherally provided with edges for holding its web outwardly from the slot during normal feeding of that web but permitting the web to be moved into the slot under the action of a relatively weak force from the pressure member of the other splicer head.

17. An apparatus according to claim 16, wherein both sides of each slot form oppositely arranged lateral grooves having a V-line profile in which the longitudinal edges of the web can be engaged.

* * * * *